US008798497B2

(12) United States Patent
Kawai

(10) Patent No.: US 8,798,497 B2
(45) Date of Patent: Aug. 5, 2014

(54) IMAGE FORMING APPARATUS

(75) Inventor: Toshiharu Kawai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/463,994

(22) Filed: May 4, 2012

(65) Prior Publication Data

US 2012/0219323 A1 Aug. 30, 2012

Related U.S. Application Data

(63) Continuation of application No. 12/560,862, filed on Sep. 16, 2009, now Pat. No. 8,204,404.

(30) Foreign Application Priority Data

Sep. 24, 2008 (JP) ..... 2008-243920

(51) Int. Cl.
*G03G 15/00* (2006.01)
*G03G 21/18* (2006.01)

(52) U.S. Cl.
CPC .... *G03G 21/1853* (2013.01); *G03G 2221/1684* (2013.01)
USPC ..... 399/110; 399/107; 399/113

(58) Field of Classification Search
USPC ..... 399/107, 110, 113
See application file for complete search history.

(56) References Cited

U.S. PATENT DOCUMENTS

| | | | | |
|---|---|---|---|---|
| 4,791,454 | A | 12/1988 | Takahashi et al. | |
| 4,866,482 | A | 9/1989 | Hirasawa et al. | |
| 5,608,498 | A | 3/1997 | Nagase et al. | |
| 6,101,349 | A | 8/2000 | Ohashi et al. | |
| 6,708,011 | B2 * | 3/2004 | Nomura et al. | 399/110 |
| 7,567,769 | B2 | 7/2009 | Noguchi et al. | |
| 2007/0147890 | A1 | 6/2007 | Hayakawa | |
| 2009/0041498 | A1 * | 2/2009 | Numagami et al. | 399/111 |
| 2009/0317127 | A1 | 12/2009 | Kishi | |

FOREIGN PATENT DOCUMENTS

| | | | |
|---|---|---|---|
| JP | 08-220824 | A | 8/1996 |
| JP | 2007-178482 | A | 7/2007 |

* cited by examiner

*Primary Examiner* — Ryan Walsh
(74) *Attorney, Agent, or Firm* — Fitzpatrick, Cella, Harper & Scinto

(57) ABSTRACT

An image forming apparatus for forming an image on a recording material includes a main assembly; a movable member movable, while supporting a cartridge including at least one of an image bearing member on which a latent image is to be formed and developing means for developing with a developer the latent image formed on the image bearing member, between an outside position in which the cartridge is located outside the main assembly and an inside position in which the cartridge is located inside the main assembly; and a cartridge displacing member for displacing the cartridge with respect to the movable member in a demounting direction in which the cartridge is demountable from the movable member in a state in which the movable member is located at the outside position.

16 Claims, 14 Drawing Sheets

IMAGE FORMING APPARATUS

This application is a continuation of application Ser. No. 12/560,862, now allowed.

FIELD OF THE INVENTION AND RELATED ART

The present invention relates to an image forming apparatus, to which a cartridge is detachably mountable, for forming an image on a recording material (medium).

The image forming apparatus includes, e.g., those of an electrophotographic type, an electrostatic recording type, a magnetic recording type, and the like, such as a copying machine, a printer (a laser beam printer, an LED printer, or the like), a facsimile machine, a word processor, and the like.

The cartridge includes at least one of an image bearing member on which a latent image is to be formed and a developing means for developing the latent image formed on the image bearing member with a developer. An apparatus main assembly is a portion of the image forming apparatus except the cartridge and a movable member for moving the cartridge. The cartridge is mountable to and demountable from the apparatus main assembly by a user himself (herself). For that reason, maintenance of the apparatus main assembly can be easily performed.

The image bearing member is a member on which the latent image (such as an electrostatic latent image, a potential latent image, a resistance latent image, or a magnetic latent image) is to be developed with the developer is formed. Examples of the image bearing member may include an electrophotographic photosensitive member in an electrophotographic process, an electrostatic recording dielectric member in an electrostatic recording process, and a magnetic recording magnetic member in a magnetic recording process.

As an exchanging method of the cartridge with respect to the apparatus main assembly of the image forming apparatus, Japanese Laid-Open Patent Application (JP-A) Hei 8-220824 discloses the following constitution. That is, a cartridge 30 is supported through a guide member 70 capable of elongating and contracting in two steps with respect to an ascending/descending board 61 which is moved forward and backward and up and down in interrelation with a side surface cover 80. The cover 80 is opened to raise and move the cartridge 30 from an image forming position (I) to a pull-out position (II), and then the cartridge 30 is directly pulled out. By the pulling-out, the cartridge 30 is optionally moved to a position including a stopping position (III) so as to perform mounting/demounting of each device and jammed paper processing.

Further, JP-A 2007-178482 discloses a constitution in which a plurality of cartridges is supported by a member movable with respect to the apparatus main assembly. According to this constitution, by inserting the movable member into the apparatus main assembly, the plurality of cartridges can be inserted simultaneously into the apparatus main assembly. Further, the movable member is pulled out from the apparatus main assembly and then a desired cartridge can be demounted from the member and can be replaced with a fresh cartridge.

SUMMARY OF THE INVENTION

The present invention have further developed the above-described conventional constitutions.

A principal object of the present invention is to provide an image forming apparatus further improved in usability by permitting easier mounting and demounting of a cartridge at a pull-out position.

According to an aspect of the present invention, there is provided an image forming apparatus for forming an image on a recording material, comprising:

a main assembly;

a movable member movable, while supporting a cartridge including at least one of an image bearing member on which a latent image is to be formed and developing means for developing with a developer the latent image formed on the image bearing member, between an outside position in which the cartridge is located outside the main assembly and an inside position in which the cartridge is located inside the main assembly; and a cartridge displacing member for displacing the cartridge with respect to the movable member in a demounting direction in which the cartridge is demountable from the movable member in a state in which the movable member is located at the outside position.

DETAILED DESCRIPTION OF THE PREFERRED EMBODIMENTS

Embodiment 1

(General Structure of Image Forming Apparatus)

Figure 1:
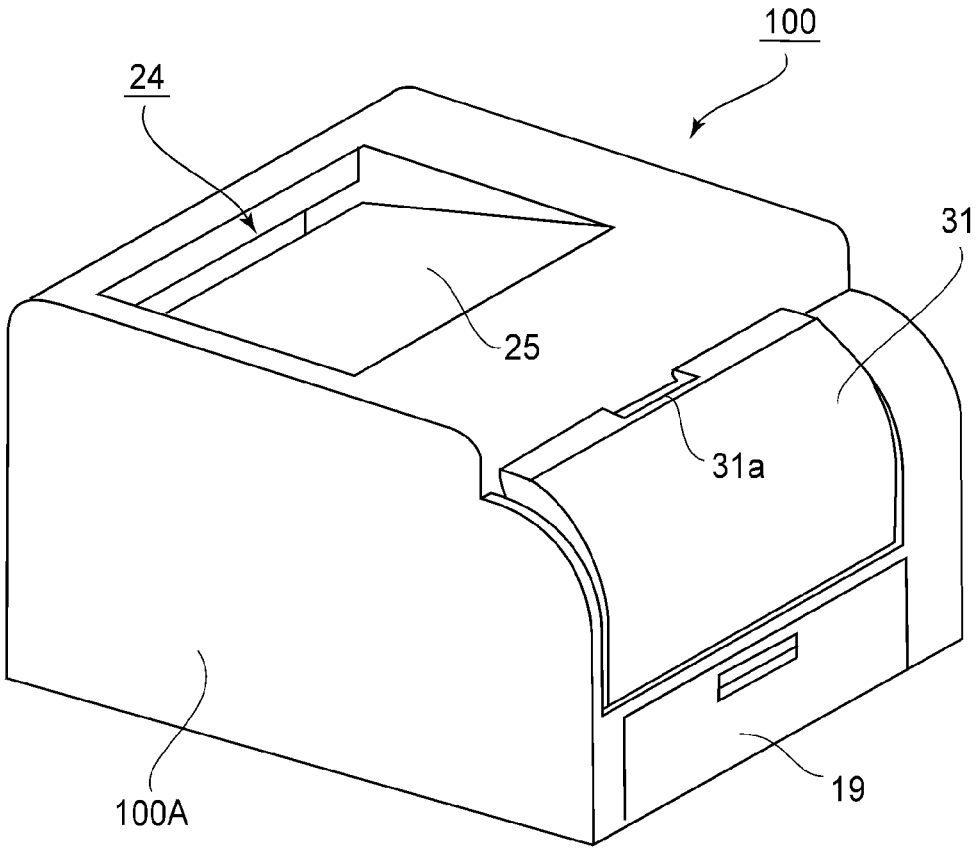
FIG. 1 is a perspective view of an outer appearance of an image forming apparatus in Embodiment 1.
Figure 2:
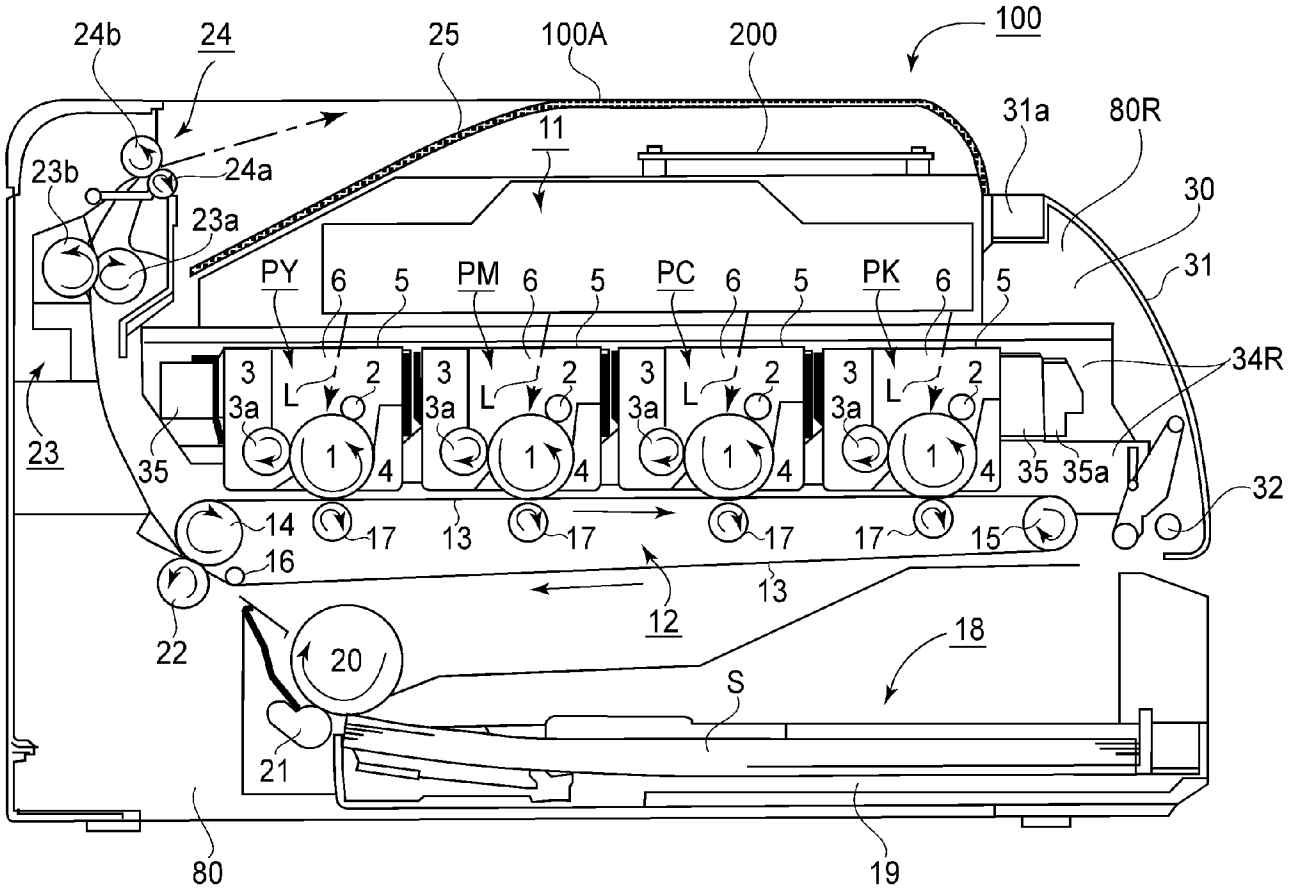
FIG. 2 is a longitudinal left side view of the image forming apparatus.

FIG. 1 is a perspective view of an outer appearance of an image forming apparatus 100 in this embodiment, and FIG. 2 is a longitudinal left side sectional view of the image forming apparatus 100. The image forming apparatus 100 is a four color-based full-color electrophotographic laser printer to which cartridges are detachably mountable. That is, the image forming apparatus 100 forms an image on a recording material (such as a sheet, an OHP sheet or a label) on the basis of an electrical image signal input from a host device (not shown) such as a personal computer, an image reader, or a remote facsimile machine into a control circuit portion (control means such as a CPU) 200 of the image forming apparatus 100. The control circuit portion 200 exchange various pieces of electrical information with the host device or an operating portion (not shown) and effects centralized control of an image forming operation of the image forming apparatus 100 in accordance with a predetermined control program and a predetermined reference table.

In the following description, a front side (front surface side) of the image forming apparatus 100 means the side on which an apparatus opening/closing door 31 as an opening/closing member is provided. A rear side of the image forming apparatus 100 is the side opposite to the front side. A front-rear direction includes a frontward direction toward front as seen from the rear side of the image forming apparatus 100 and a rearward direction opposite to the frontward direction. The left and right sides means the left and right sides as seen from the front side of the image forming apparatus 100. A left-right direction includes a leftward direction toward left as seen from the front side and a rightward direction opposite to the leftward direction. An apparatus main assembly 100A is a portion of an image forming apparatus except the cartridges and a movable member.

In the apparatus main assembly 100A, four (first to fourth) cartridges PY, PM, PC and PK are horizontally arranged in the listed order in terms of the rear-to-front direction (inline or tandem arrangement). The four cartridges have the same constitution except that colors of toners accommodated therein are different from each other. Each cartridge in this embodiment includes a drum-type electrophotographic photosensitive member 1 as an image carrying member 1 as an image bearing member on which a latent image to be developed with the toner (developer) is formed (hereinafter simply referred to as a "drum"). Each cartridge further includes a charging device (charging means) 2, developing device (developing means) 3, and a cleaning device (cleaning means) 4 which are used as process means acting on the drum 1. Further, each cartridge is a process cartridge prepared by integrally mounting the above-described drum 1, the charging device 2, the developing device 3, and the cleaning device 4 in a cartridge frame (outer casing) 5. The charging device 2 is contact charging roller. The developing device 3 includes a developing roller 3*a* as a developer carrying member (developer supplying member) for carrying the developer (toner) for developing the latent image formed on the drum 1 and includes a developer container (developer accommodating portion). The cleaning device is of a blade type.

The developing device 3 of the first cartridge PY stores yellow (Y) toner. On the surface of the drum 1 at the image forming portion PY, a toner (developer) image of yellow (Y) is formed. The developing device 3 of the second cartridge PM stores magenta (M) toner. On the surface of the drum 1 at the image forming portion PM, a toner image of magenta (M) is formed. The developing device 3 of the third cartridge PC stores cyan (C) toner. On the surface of the drum 1 at the image forming portion PC, a toner image of cyan (C) is formed. The developing device 3 of the fourth cartridge PK stores black (K) toner. On the surface of the drum 1 at the image forming portion PK, a toner image of black (K) is formed.

In the area above the first to fourth cartridges PY, PM, PC, and PK, a laser scanner unit 11 as an exposure device is disposed. This scanner unit 11 outputs a beam of laser light L modulated correspondingly to image (picture) information for each color inputted from the host device into the control circuit portion 200. The outputted laser light L enters each cartridge through an exposure window 6 provided to an upper surface plate of the cartridge frame 5. Thus, laser scanning exposure is performed on the surface of the drum 1.

The apparatus main assembly 100A includes an intermediary transfer belt unit 12. This belt unit 12 is disposed below the cartridges P (PY, PM, PC, PK). The belt unit 12 includes an endless belt 13. The belt 13 is an intermediary transfer member (intermediary transfer belt) contactable to the drum 1 of each cartridge P in order to form an image on a recording material (hereinafter referred to as a sheet) S. The belt 13 is formed of a dielectric material and has flexibility. Inside the belt 13, a driving roller 14, a turn roller 15, and a tension roller 16 around which the belt 13 is stretched and circulatively moved. The driving roller 14 and tension roller 16 are disposed on the rear side of the apparatus main assembly 100A. The turn roller 15 is disposed on the front side of the apparatus main assembly 100A. A lower surface of the drum 1 of each cartridge P contacts an upper surface of an upper belt portion of the belt 13. Inside the belt 13, four primary transfer rollers 17 are disposed. Each transfer roller 17 is disposed opposite to the drum 1 at the corresponding cartridge P through the upper belt portion of the belt 3. The driving roller 14 is disposed opposite to a secondary transfer roller 22 through the belt 13.

Below the belt unit 12, a sheet feeding unit 18 is disposed, which includes a sheet feeding cassette 19 in which the sheets S are stacked and accommodated, a feeding roller 20, and a separation pad 21, and the like. The sheet feeding cassette 19 is detachably mountable in the apparatus main assembly 100A from the front side (front loading).

At an upper portion on the rear side of the apparatus main assembly 100A, a fixing device 23 and a sheet discharging roller pair 24 are disposed. Further, at an upper surface of the apparatus main assembly 100A, a sheet discharging portion 25 is provided. The fixing device 23 includes a fixation film assembly 23*a* and a pressing roller 23*b*. The sheet discharging roller pair 24 includes sheet discharging rollers 24*a* and 24*b*.

Each cartridge P located at a transfer contact position (latent image forming position) in the apparatus main assembly 100A is urged by an urging member (not shown) to be fixed to a predetermined positioning portion. The transfer contact position means a position at which the drum 1 and the belt 13 contact each other and at which a latent image can be formed on the drum 1. At this transfer contact position, a drum driving force input portion 53 and a developing device driving force input portion 54 of the cartridge P (FIG. 3) are in engagement with a drum driving force output portion (not shown) and a developing device driving force output portion (not shown) of the apparatus main assembly 100A. By a driving force transmitted from the drum driving force output portion to the drum driving force input portion 53, the drum 1 is rotationally driven in a counterclockwise direction indicated by an arrow at a predetermined speed. Further, by the transmission of the driving force fro the developer device driving force output portion to the developing device driving force input portion 54, the developing roller 52 is rotationally driven. To electrical contacts 55*a* and 55*b* (FIG. 4) of P, an electric energy supplying system (not shown) of the apparatus main assembly 100A is electrically connected. The electrical contact 55*a* is used for applying a charging bias. The electrical contact 55*b* is used for applying a developing bias.

An operation for forming a full-color image is as follows. On the basis of a print start signal, the drum 1 of each of the first to fourth cartridges PY, PM, PC and PK is rotationally driven at the predetermined control speed in the counter-clockwise direction indicated by the arrow. Further, the belt 13 is rotationally driven in the clockwise direction indicated by an arrow (the (normal) rotational direction of the drum 1) at a speed which corresponds to the speed of the drum 1. The scanner unit 11 is also driven. In synchronization with the driving of the scanner unit 11, the charging roller 2 in each cartridge P uniformly electrically charges the surface of the drum 1 to predetermined polarity and potential with a predetermined control timing. The scanner unit 11 scans (exposes) the surface of each drum 1 with the beam of laser light L modulated correspondingly to the picture (image) signal for an associated colors. As a result, an electrostatic latent image corresponding to the picture signal for the associated color is formed on the surface of the drum 1. This electrostatic latent image is developed by the developing device 3 into a toner image. To each of the primary transfer roller 17, a predetermined primary transfer bias is applied with predetermined control timing.

Through the above described electrophotographic image forming process operation, a yellow toner image, which corresponds to the yellow color component of a full-color image is formed on the drum 1 of the first cartridge PY. This yellow toner image is primary-transferred onto the belt 13 by the primary transfer bias and primary transfer pressure.

On the drum 1 of the second cartridge PM, a magenta toner image, which corresponds to the magenta component of the full-color image is formed, and this toner image is primary-transferred onto the belt 13 by the primary transfer bias and primary transfer pressure so that it is superposed on the yellow toner image which has already been transferred on the belt 13.

On the drum 1 of the third cartridge PC, a cyan toner image, which corresponds to the cyan component of the full-color image, is formed and this toner image is primary-transferred onto the belt 13 by the primary transfer bias and primary transfer pressure so that it is superposed on the yellow and magenta toner images which have already been transferred the belt 13.

On the drum 1 of the fourth cartridge PK, a black toner image, which corresponds to the black component of the full-color image, is formed and this toner image is primary-transferred onto the belt 13 by the primary transfer bias and primary transfer pressure so that it is superposed on the yellow, magenta, and cyan toner images which have already been transferred on the belt 13.

Consequently, an unfixed full-color toner image is synthetically formed on the belt 13 by the yellow, magenta, cyan and black toner images.

In this embodiment, after the primary transfer of the toner images onto the belt 13, the untransferred toner remaining on the surface of the drum 1 at each cartridge P is removed by the cleaning device 4.

Meanwhile, the sheet feeding roller 20 is driven with a predetermined control timing. Sheets S stacked on the sheet feeding cassette 19 are separated and fed one by one by cooperation of the sheet feeding roller 20 and the separation pad 21 to be introduced into a nip (secondary transfer nip) between the secondary transfer roller 22 and belt 13. To the secondary transfer roller 22, a predetermined secondary transfer bias is applied with predetermined control timing. During nip-conveyance of the sheet S, superposed four color toner images are simultaneously secondary-transferred onto the sheet S by the secondary transfer bias and secondary transfer pressure.

The sheet S is separated from the surface of the belt 13 and introduced into the fixing device 23, and is subjected to heat and pressure in a fixation nip of the fixing device 23. As a result, color mixing of the respective color toner images and fixation thereof on the sheet S are performed. Thereafter, the sheet S is moved out of the fixing device 23, and then, is discharged as a full-color image formation product onto the sheet discharge portion 25 by the discharge roller pair 24.

In this embodiment, after the separation of the sheet P from the belt 13, secondary-transfer residual toner remaining on the surface of the belt 13 is electrostatically deposited on the drum 1 surface at the primary transfer portion of, e.g., the first cartridge PY and is removed by the cleaning device 4.

(Cartridge P)

Figure 3:
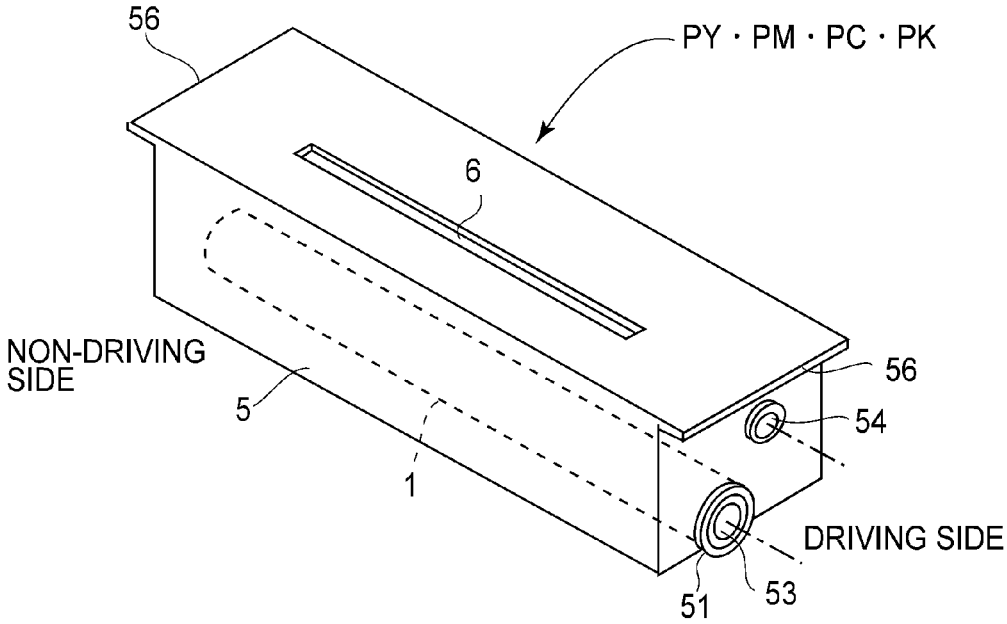
FIG. 3 is a perspective view of an outer appearance of a cartridge as seen from a driving side.
Figure 4:
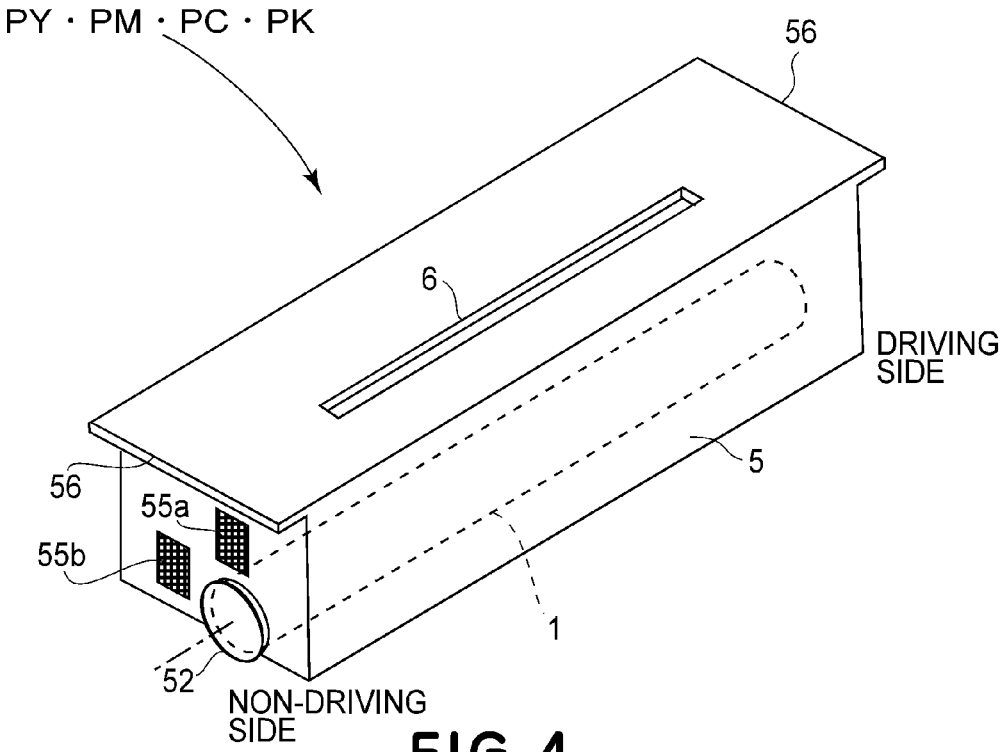
FIG. 4 is a perspective view of an outer appearance of the cartridge as seen from a non-driving side.

FIG. 3 is a perspective view of the cartridge P as seen from the driving side and FIG. 4 is a perspective view of the cartridge P as seen from the non-driving side.

Each cartridge P is an elongated box-type assembly extending in the axial direction of the drum 1 as the left-right direction (longitudinal direction). The drum 1 is rotatably supported, in the cartridge frame 5, between shaft supporting portions 51 and 52 provided at left and right side surface portions of the cartridge frame 5. The upper surface plate of the cartridge frame 5 is provided with the exposure window portion 6. To the right shaft supporting portion 51, a coupling engaging portion 53 as the drum driving force input portion for driving the developing roller 3*a*. To the left side surface portion of the cartridge frame 5, the electrical contact 55*a* for applying the charging bias to the charging roller 2 and the electrical contact 55*b* for applying the developing bias to the developing roller 3*a* are provided. At upper portions of the left and right side surface portions of the cartridge frame 5, the eaves 56 are provided by extending and projecting the upper surface portion of the cartridge frame 5 in the left-right direction. With respect to the cartridge, the right side surface portion side provided with the coupling engaging portions 53 and 54 is the driving side and the left side surface portion side opposite from the right side surface portion side is the non-driving side.

(Cartridge Exchange)

As each cartridge (PY, PM, PC, PK) is used for image formation, the toner (developer) stored in the developing device 3 is consumed. Then, when the developer is consumed to such an extent that an image of a quality satisfactory to a user who has purchased the cartridge cannot be formed, the exchange of the cartridge 3 is required.

For this reason, e.g., the image forming apparatus is provided with a means (not shown) for detecting an amount of the developer remaining in each cartridge. The detected amount of the developer in each cartridge is compared, by the control circuit portion 200, with a threshold value preset for providing a prewarning or warning of its lifetime of the cartridge. When the detected amount of the residual developer in the cartridge is smaller than the preset threshold value, the prewarning or warning of its lifetime of the cartridge is displayed on a display portion (not shown). As a result, the image forming apparatus prompts the user to prepare a cartridge for exchange, or to replace the cartridge with a fresh cartridge, in order to maintain an output image quality.

In this embodiment, the exchange (replacement) of the cartridge with respect to the image forming apparatus is performed through a method in which cartridge P is placed on a cartridge tray 35 as a pull-out type frame-like movable member and is replaced in a front-access manner in order to improve usability.

On the front side of the apparatus main assembly 100A, an opening 30 through which the tray 35 (cartridge P) passes when the cartridge P is pushed in the inside of the apparatus main assembly 100A or is pulled out from the apparatus main assembly 100A is provided.

Further, on the front side of the apparatus main assembly 100A, a rotatable door 31 is provided. This door 31 is an opening/closing member locatable at a closing position for permitting closing the opening 30 and at an opening position for permitting opening the opening 30.

Figure 5:
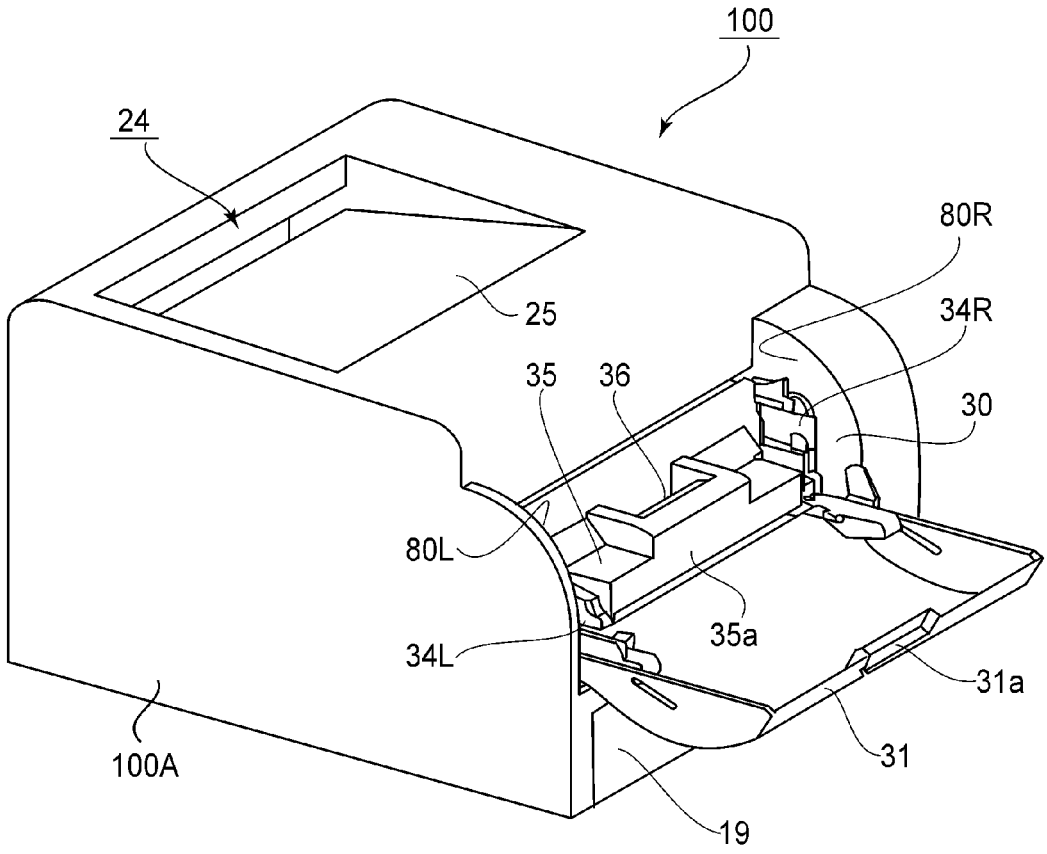
FIG. 5 is a perspective view of an outer appearance of the image forming apparatus in a state in which a front door is opened.
Figure 6:
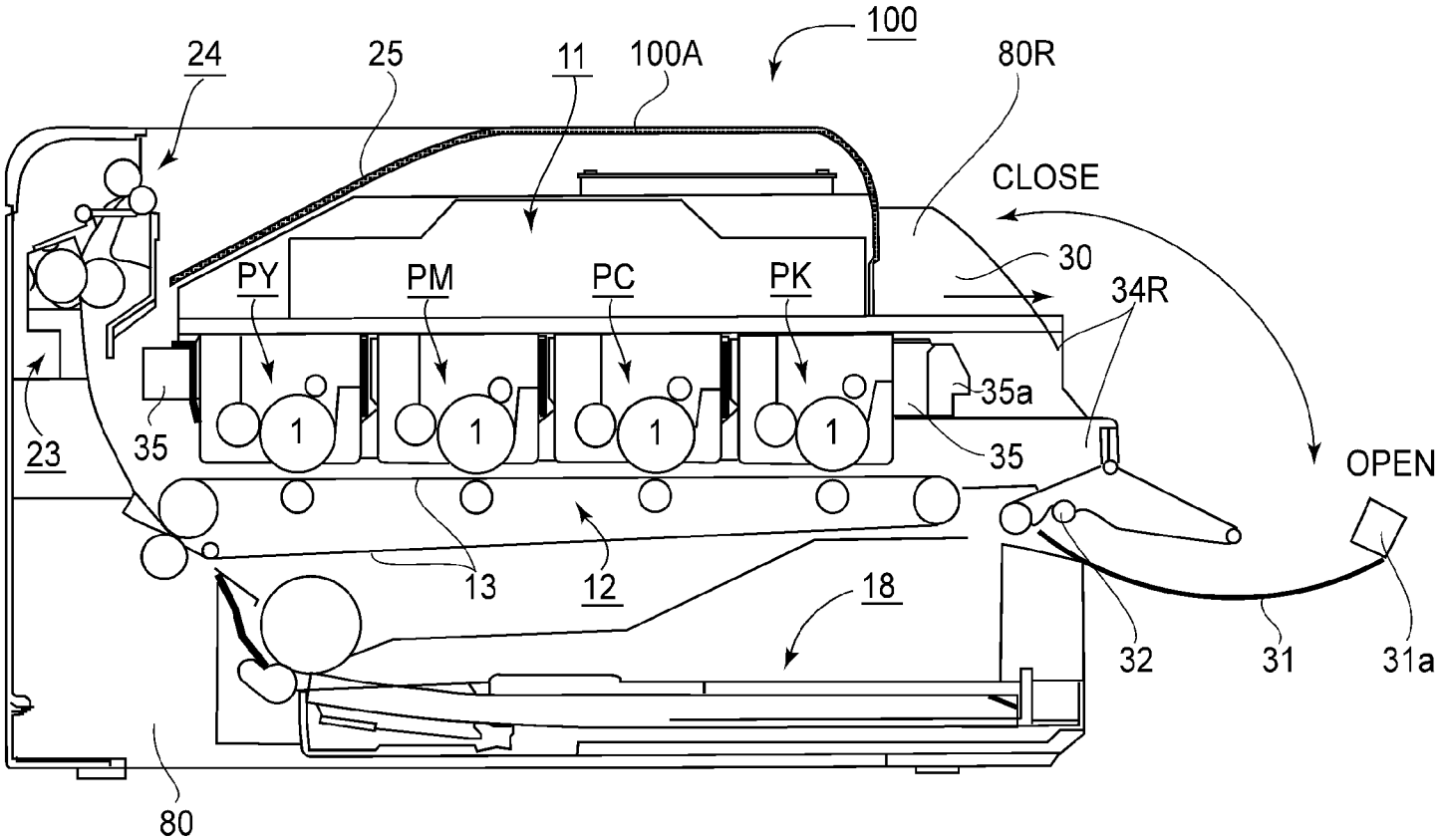
FIG. 6 is a longitudinal left side view of the image forming apparatus shown in FIG. 5.

In this embodiment, the door 31 can be opened and closed and can be rotationally moved relative to the apparatus main assembly 100A about a horizontal (lateral) shaft (hinge shaft) 32 provided at a lower portion of the door 31. The door 31 is rotated about the horizontal shaft 32 so that it can be moved into the closed position (roughly vertical position) to close the opening 30 as shown in FIGS. 1 and 2, and also, so that it can be rotated frontward about the shaft 32 into the open position (roughly horizontal position), as shown in FIGS. 5 and 6, to open the opening 30. To the door 31, a holding portion (finger placement portion) 31*a* for opening/closing the door 31 is provided.

Referring to FIGS. 5 and 6, inside left and right frames 80L and 80R of a main frame 80 of the apparatus main assembly 100A, a pair of left and right rail members 34 (34L and 34R) as a tray holding member (movable means) are disposed, respectively. These rail members 34 oppose each other. A longitudinal (lengthwise) direction of each of the rail members 34 coincides with the front-rear direction of the apparatus main assembly 100A. Between the rail member 34, the tray 35 is disposed. This tray 35 is held by the rail members 34 so that the tray 35 can be horizontally slid in the front-rear direction of the apparatus main assembly 100A. The tray 35 supports the cartridge P. That is, the tray 35 includes mounting portions to which the plurality of cartridges PY, PM, PC and PK are detachably mountable.

In interrelation with the opening of the door 31, the rail members 34 are moved both frontward and upward of the apparatus main assembly 100A by predetermined distances through an interrelating mechanism (not shown). That is, the rail members 34 are moved from a first position to a second position. Here, the first position is a position of the rail members 34 in which the tray 35 cartridge P is moved to a transfer contact position (FIG. 2), and the second position is a position of the rail members 34 in which the tray 35 is moved between a push-in position (FIG. 6) and a pull-out position (FIGS. 7 and 8) with respect to the apparatus main assembly 100A. The push-in position is a position (inside position) at which the tray 35 is pushed in the inside of the apparatus main assembly 100A until the tray 35 runs against and is stopped by a stopper portion (not shown) provided to the rail members 34. The pull-out position is a position at which the tray 35 is pulled out to the outside of the apparatus main assembly 100A and the cartridges are detachably mountable to the above-described mounting portion). The movement direction of the tray 35 is perpendicular to the axial direction of the drum 1 of each cartridge P. The rail members 34 are moved from the first position (FIG. 2) to the second position (FIG. 6), whereby front portions thereof are projected frontward by a predetermined distance. As a result, a grip portion 35*a* provided at a front frame portion of the tray 35 is exposed.

In interrelation with the movement of the rail members 34 from the first position to the second position, drive output portions on the apparatus main assembly side are disengaged from corresponding drive input portions 53 and 54 of each cartridge P (driven portion disengagement). Further, the urging by the urging member which positions and fixes each cartridge P is released (urging release). Further, electrical conduction of an electric energy supplying system on the apparatus main assembly 100A side to the electrical contacts 55*a* and 55*b* of each image forming portion P is ceased (electrical disconnection). Further, the positional fixation of the tray 35 by a positioning and fixing means (not shown) is unfixed.

As described above, when the rail members 34 are moved from the first position to the second position, the tray 35 and each cartridge P are moved upward together with the rail members 34, so that the drum 1 is separated from the belt 13 (FIG. 6). That is, the tray 35 is moved from the transfer contact position (FIG. 2) in which the drum 1 and the belt 13 contact each other to the transfer separation position (push-in position) (FIG. 6) in which the drum 1 and the belt 13 are separated from each other.

In a state in which the door 31 is opened as shown in FIGS. 5 and 6, the grip portion 35*a* of the tray 35 exposed through the opening 30 is gripped. Inside the grip portion 35*a*, a locking mechanism (movement regulating means; not shown) for regulating movement of the tray 35 and a lever (movement regulation releasing means) 36 for releasing the locking are provided. By gripping the grip portion 35 to swing the lever 36, the locking mechanism is unlocked. That is, the tray 35 can be moved and pulled out.

Figure 7:
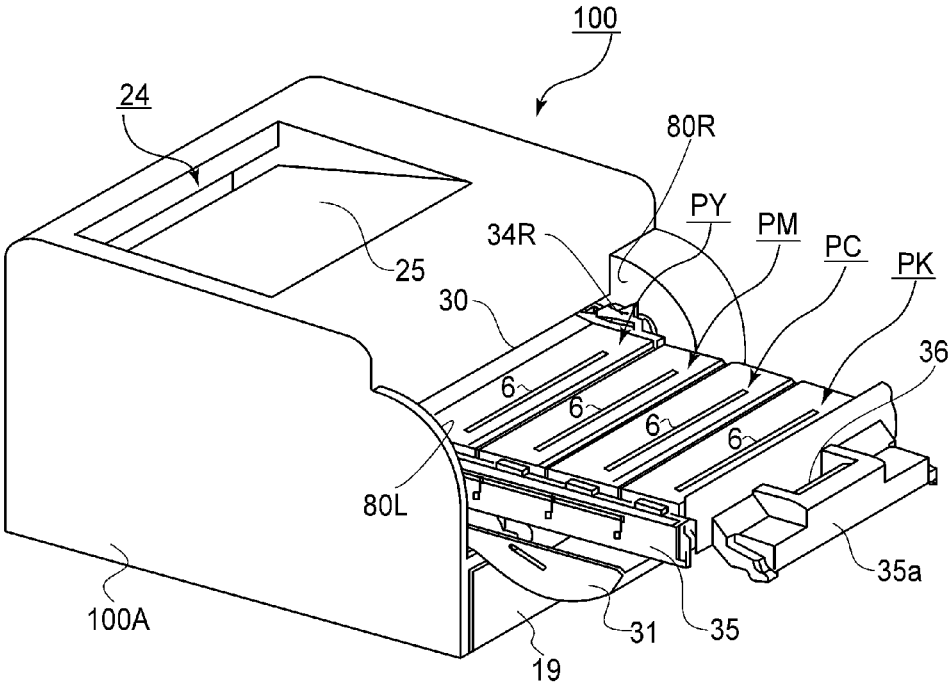
FIG. 7 is a perspective view of an outer appearance of the image forming apparatus in a state in which a tray is pulled out from the state shown in FIG. 5.
Figure 8:
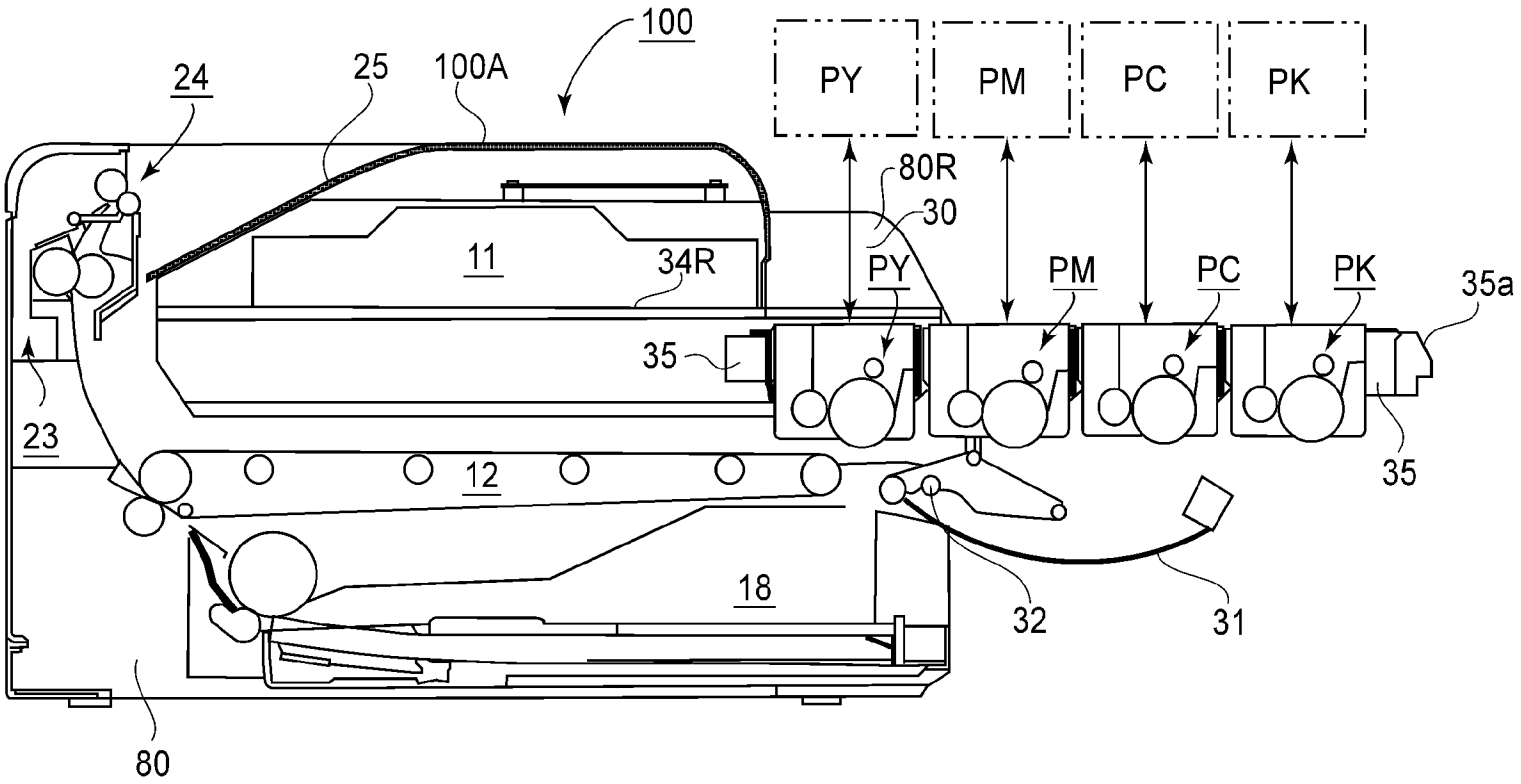
FIG. 8 is a longitudinal left side view the image forming apparatus in a state in which a tray is pulled out from the state shown in FIG. 6.

The tray 35 is moved along the rail members 34 while gripping a grip portion 35*a*, so that the tray 35 is sufficiently pulled out from the inside to the outside of the apparatus main assembly 100A. That is, the tray 35 is slid along the rail members 34 so as to be pulled out, thus being slidably moved horizontally and frontward. Then, as shown in FIGS. 7 and 8, the tray 35 is pulled out through the opening 30 to a predetermined pull-out position located outside the apparatus main assembly 100A.

As a result, the entire four cartridges P held by the tray 35 pass through the opening 30 and are pulled out to the outside of the apparatus main assembly 100A. That is, the tray 35 is moved from the push-in position (FIGS. 5 and 6) to the pull-out position (FIGS. 7 and 8), so that upper (top) surfaces of all the cartridge P are exposed.

When the tray 35 is pulled out by a preset predetermined distance, it is prevented by an unshown stopper portion from being pulled out further. The tray 35 is held in this horizontally pulled out state by the rail members 34. In this pull-out movement of the tray 35, the drum 1 of each cartridge P and the belt 13 are separated from each other, so that friction therebetween is not caused to occur.

The tray 35 supports each cartridge P so as to be detachably movable directly above. As shown by chain double-dashed lines in FIG. 8, a spent cartridge 3 to be replaced is raised and removed above from the tray 35. The tray 35 supports each cartridge P by moving each cartridge P directly below. Thus, a fresh cartridge is engaged in and placed on the tray from above. After the cartridge is exchanged with respect to the tray 35, the tray 35 is moved from the pull-out position (FIGS. 7 and 8) to the push-in position (FIGS. 5 and 6). When the tray 35 is sufficiently moved and pushed in until the tray 35 is stopped by a stopper portion (not shown), the tray 35 is prevented from being moved back by the locking mechanism (not shown). Then, the door 31 is closed. In interrelation with the closing of the door 31, the rail members 34 are moved from the second position (FIG. 6) to the first position (FIG. 2) through the interrelating mechanism, (not shown), so that the tray 35 is moved from the push-in position to the transfer contact portion (latent image forming position). Further, in interrelation with the movement of the rail members 34, each cartridge P is urged by the urging member to be fixed at the predetermined positioning portion. As a result, the lower surface of the drum 1 of each cartridge P contacts a predetermined position of the belt 13. To the drive output portions (not shown) on the apparatus main assembly 100A side are connected to the drive input portions 53 and 54 of each cartridge P. Further, to the electrical contacts 55*a* and 55*b*, the energy supplying system (not shown) on the apparatus main assembly 100A side is electrically connected. Further, the tray 35 is positioned and fixed by the positioning and fixing means.

In summary, the tray 35 is the movable member provided movably in the direction intersecting with the axial direction of the drum 1 of each cartridge P. Further, the tray 35 passes through the opening 30 and is movable to the pull-out position in which the tray 35 is pulled out to the outside of the apparatus main assembly 100A. Further, the tray 35 is movable to the push-in position (inside position) in which the cartridges are pushed into the inside of the apparatus main assembly 100A. The tray 35 can take the mounting position in which each cartridge P is mountable inside the apparatus main assembly 100A and the transfer contact position in which the drum 1 is contactable to the belt 13 (a latent image forming position in which the latent image is formable on the drum 1). The left and right tray holding (rail) members 34L and 34R are movable means for moving the tray 35 from the mounting position in the upward direction before the tray 35 as the movable member is moved to the pull-out position in which each cartridge P is detachably mountable. Alternatively, the holding members 34L and 34R are movable means for moving the tray 35 toward the mounting portion in the downward direction. In other words, the holding members 34L and 34R are a supporting member for supporting the tray 35 and can take the first position in which the tray 35 is movable between the pull-out position and the mounting position and can take the second position in which the tray 35 is locatable at the latent image forming position. Further, in interrelation with the closing the door 31, the tray holding members 34L and 34R are moved from the first position to the second position.

(Tray 35)

A constitution of the tray 35 will be described with reference to FIGS. 9 to 12.

Figure 9:
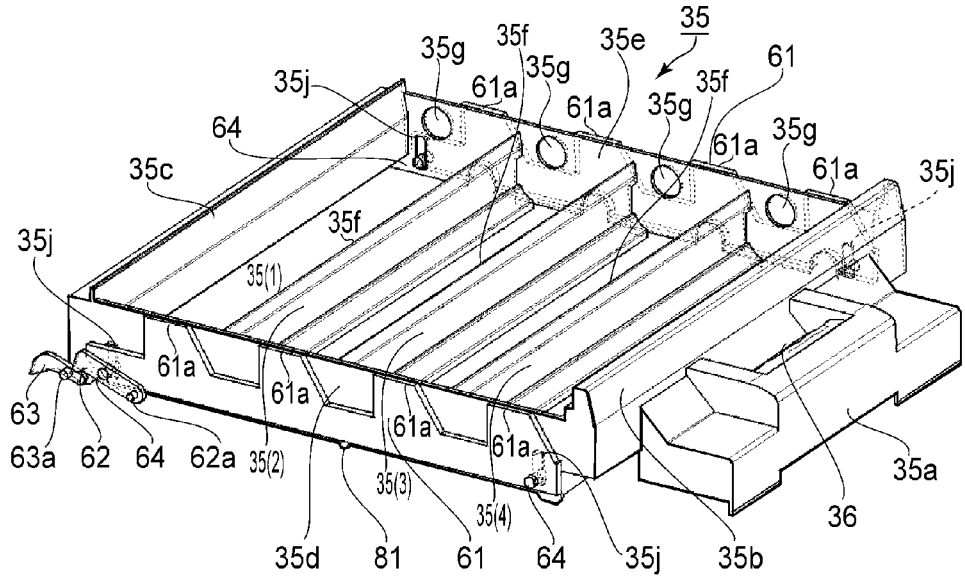
FIG. 9 is a perspective view of the tray.

As shown in a perspective view of FIG. 9, the tray 35 includes a rectangular frame portion prepared by connecting a front frame plate 35*b*, a rear frame plate 35*c*, a left frame plate 35*d*, and a right frame plate 35*e*. The inside of the frame work portion is substantially equal partitioned into four areas by three partitioning plates 35*f* with respect to the front-rear direction of the framework portion, so that first to fourth small frame portions 35(1) to 35(4) from the rear frame plate 35*c* side to the front frame plate 35*b* side are formed in this order. Each of the small frame plates 35(1) to 35(4) is an elongated frame plate extending in the left-right direction. The small frame plates 35(1), 35(2), 35(3) and 35(4) are mounting portion to which the first to fourth cartridges PY, PM, PC and PK are detachably mountable, respectively. With respect to each of the small frame portions 35(1) to 35(4), the right frame plate 35*e* is provided with a hole 35*g* though which a developing device driving coupling (not shown) which is a developing device driving force output portion on the apparatus main assembly 100A side passes.

Outside the left and right frame plates 35*d* and 35*e* of the tray 35, lifting members 61 extending in the front-rear direction as the longitudinal direction are disposed in a bilateral symmetry manner. At each of the front and rear portions of the left and right frame plates 35*d* and 35*e*, an elongated groove 35*j* extending in the vertical direction as the longitudinal direction. On the other hand, at each of the front and rear portions of the left and right lifting members 61, a boss 64 is provided. The bosses provided at the front and rear portions of the left lifting members 61 are inserted into associated grooves 35*j* provided at the front and rear portions of the left frame plates 35*d*, respectively, the left lifting member 61 is slidably movable in the vertical direction with respect to the left frame plate 35*d* by being guided by the boss 64 and the groove 35*j*. Further, bosses provided at the front and rear portions of the right lifting members 61 are inserted into associated grooves 35*j* provided at the front and rear portions of the right frame plates 35*e*, respectively, the right lifting member 61 is slidably movable in the vertical direction with respect to the right frame plate 35*e* by being guided by the boss 64 and the groove 35*j*.

That is, each of the left and right lifting members 61 is slidably movable in the vertical direction with, as an ascending end point, a position in which the boss 64 contacts and is stopped by a lower end surface of the groove 35*j* and with, as a descending end point, a position in which the boss 64 contacts and is stopped by an upper end surface of the groove 35*j*.

Figure 10:
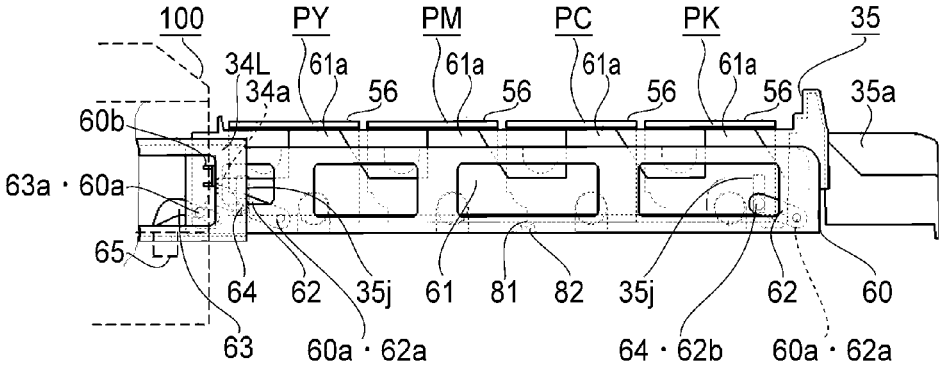
FIG. 10 is a left side view of the tray immediately before completely pulled out.
Figure 11:
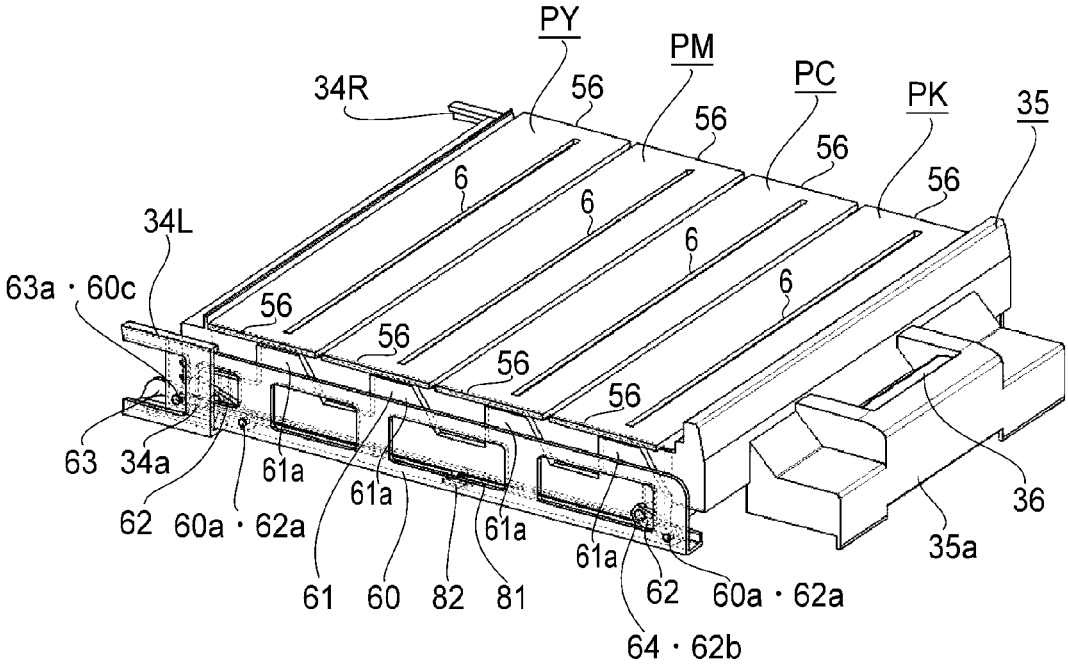
FIG. 11 is a perspective view of the tray immediately before completely pulled out.

The left and right lifting members 61 are normally located at the descending end point. At this position, upper surfaces (upper edge portions) 61*a* of the left and right lifting members 61 are substantially leveled with upper edge portions of the left and right frame plates 35*d* and 35*e* of the tray 35. Each of the first to fourth cartridges, PY, PM, PC and PK is inserted from above into an associated portion of the first to fourth small frame portions 35(1) to 35(4) as the mounting portion of the tray 35. Then, lower surfaces of the left and right eaves 56 are stopped by the upper surfaces 61*a* of the left and right lifting members 61, so that each cartridge P is accommodated in and supported by the tray 35 (FIGS. 10 and 11). That is, the tray 35 supports each cartridge P demountably right above and supports each cartridge P by moving each cartridge P right below. The tray 35 through supports each of the cartridges. As a result, it is possible to easily perform exchange of each cartridge.

Figure 12:
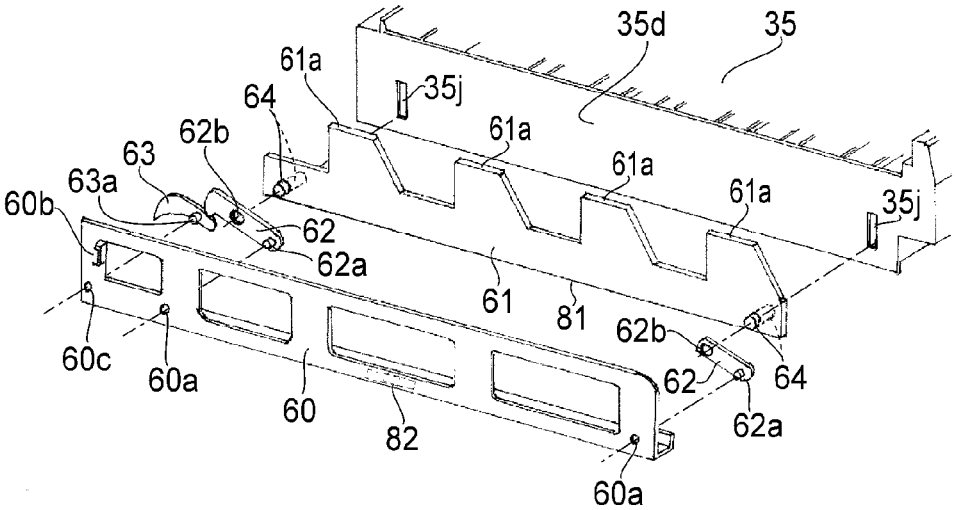
FIG. 12 is an exploded perspective view of a left side plate of the tray.

Outside the left and right lifting members disposed outside the left and right frame plates 35*d* and 35*e* of the tray 35, left and right auxiliary rails 60 (of which the right auxiliary rail is not shown) extending in the front-rear direction as the longitudinal direction are mounted. As shown in an exploded perspective view of FIG. 12, the auxiliary rail 60 and the lifting member 61 are connected to each other through front and rear links 62 disposed therebetween. Each of the links 62 is provided with a boss 62*a* on one end portion side and a round hole 62*b* on the other end portion side. Each boss 62*a* is rotatably movably inserted into an associated round hole 60*a* provided to the auxiliary rail 60. Into each round hole 62*b*, an associated boss 64 provided to the lifting member 61 is rotatably movably inserted. FIG. 12 is the exploded perspective view showing the left frame plate 35*d* of the tray 35, the left lifting member 61, the link 62, and the left auxiliary rail 60. The right auxiliary rail and the right lifting member 61 are also connected to each other through the front and rear links 62 similarly as in the case of the left auxiliary rail 60 and the left lifting member 61 so as to establish a bilateral symmetry structure.

The tray 35 is supported between the left and right rail members 34L and 34R of the apparatus main assembly 100A in a state in which the lifting members 61 and the auxiliary rails 60 are provided on the left and right sides of the tray 35 as described above. That is, the left and right auxiliary rails 60 are engaged with and supported by the grooves which are provided to the left and right rail members 34L and 34R and extend in the front-rear direction. The tray 35 is horizontally slidably movable in the front-rear direction with respect to the rail members 34 while sliding along the grooves of the rail member 34 together with the lifting members 61 and the auxiliary rails 60.

Figure 13:
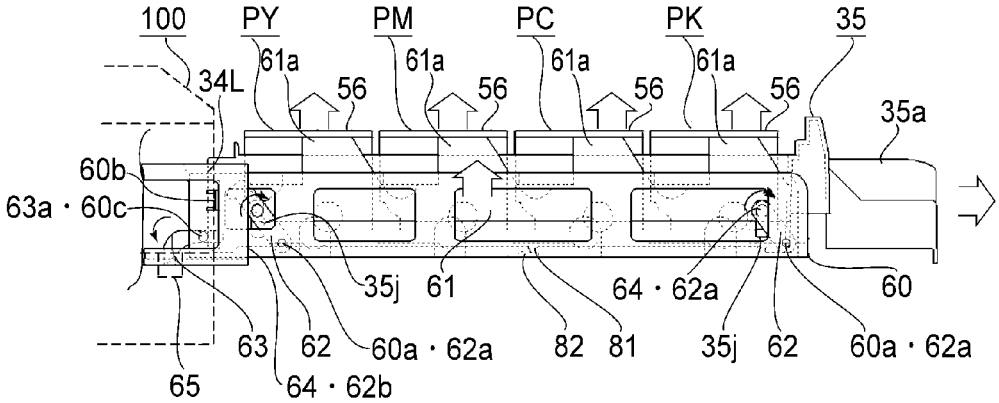
FIG. 13 is a left side view of the tray in a state in which the tray is completely pulled out.
Figure 14:
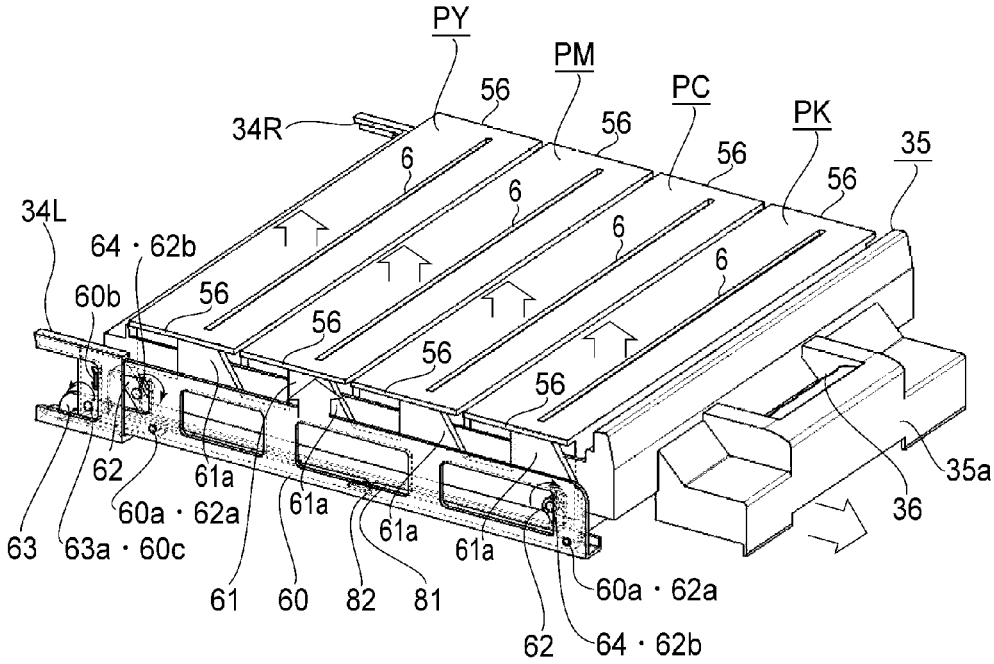
FIG. 14 is a perspective view of the tray in a state in which the tray is completely pulled out.

The tray 35 is pulled out from the push-in position to the pull-out position with respect to the apparatus main assembly 100A together with the lifting members 61 and the auxiliary rails 60. Immediately before the tray 35 is completely pulled out, as shown in FIG. 10, the auxiliary rails 60 are stopped in such a manner that stopper portions 60*b* of the auxiliary rails 60 are caught by receiving portions 34*a* of the rail members 34. After the auxiliary rails 60 are stopped, when the tray 34 is further pulled out, the rail member 61-side bosses 64 engaged with the tray 35-side grooves 35*j* are correspondingly pulled toward the front side. As a result, rotational movement moment acts on the links 62 with the bosses 62*a* as a center thereof with respect to a standing (erecting) direction, so that the links 62 are rotationally moved in the standing direction. At this time, the bosses 64 are moved upwardly in the grooves 35*j*. Thus, the left and right lifting members 61 are raised by the rotational movement of the links 62 in the standing direction. That is, each cartridge P (PY, PM, PC, PK) is pushed up by the left and right lifting members 61 to pop up from the mounting portion of the tray 35. FIGS. 13 and 14 show a state in which the respective cartridges PY, PM, PC and PK pop up from the tray 35. The left and right lifting members 61 hold the cartridges P accommodated in the tray 35 in a raised state changed from an accommodated state when the tray 35 is pulled out to the pull-out position in which each cartridge P is mountable and demountable. In this state, side surfaces of each cartridge is raised from the side walls of the tray 35 so as to accessible, so that they can be used as an operating portion at the time of demounting the cartridge by being provided with a grip or the like.

Figure 20:
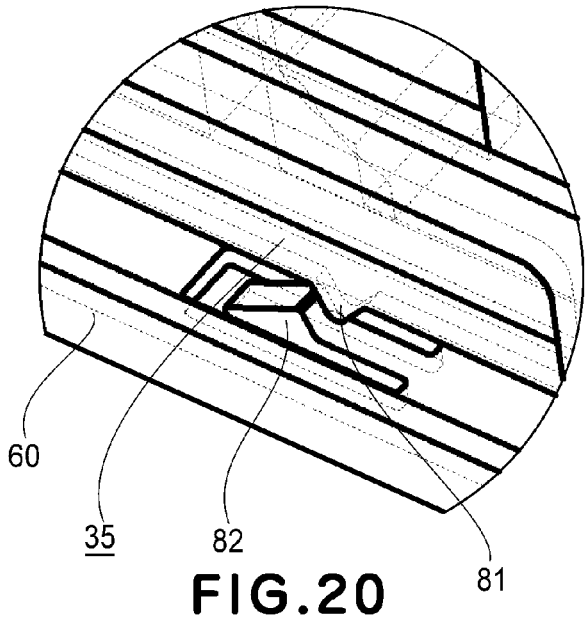
FIG. 20 is an enlarged view of a hook and a claw.

Here, the tray 35 is provided with a claw 81 and the auxiliary rail 60 is provided with a hook 82 as shown in FIG. 20. Referring to FIG. 20, the hook 82 as an engaging portion is elastically deformable by a force applied from the claw 81 as a portion to be engaged.

Figure 21:
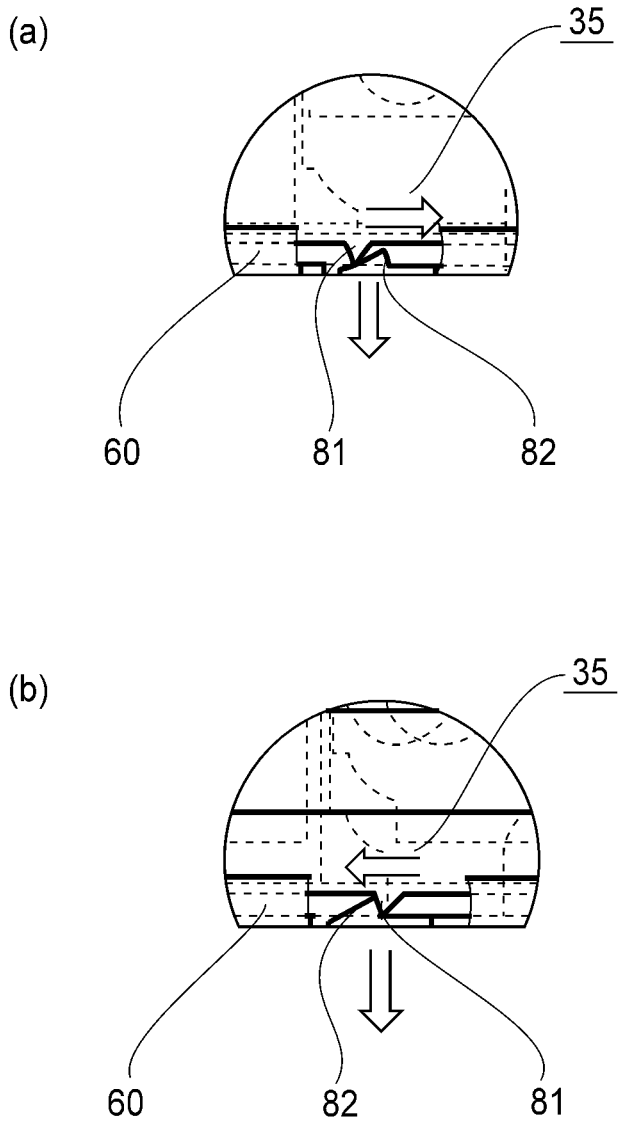
FIG. 21(*a*) is a schematic view showing a state of the hook and the claw immediately before engagement therebetween, and FIG. 21(*b*) is a schematic view showing a state in which the hook and the claw are engaged with each other.

After the auxiliary rail 60 is stopped by the stopper portion during the pulling-out operation, from the state shown in FIG. 21(*a*), the tray 35 is further pulled out, so that the claw 81 rides over the hook 82 and is stopped in a state shown in FIG. 21(*b*). At this time, as described above, the process cartridge is raised by the links 62 and the lifting members 61 but the tray 35 is locked by the auxiliary rails 60 so that the links 62 and the lifting members 61 are not returned to an accommodation position by the weight of the cartridge P. This locking action is sufficient to support a returning force by the weight of the cartridge P, so that the cartridge P can be held at the pull-out position during the cartridge exchanging operation by the user. Further, the upper pushes back the tray 35, so that the claw 81 rides over the hook again to be changed from the state of FIG. 21(*b*) to the state of FIG. 21(*a*). By click feeding at the time of the engagement between the claw 81 and the hook 82, the user can recognize a pull-out completion position.

In this embodiment, the above-described left and right lifting members 61 are a cartridge displacing member for displacing the cartridge P, supported by the tray 35 pulled out to the pull-out position, in the mounting and demounting direction in the tray (movable member).

The auxiliary rail 60 is rotatably provided with a fixing member 63 at the rear portion thereof. That is, the fixing member 63 is lever-like member and is provided with a boss 63*a*. The boss 63*a* is rotatably inserted into a round hole 60*c* provided at the rear portion of the auxiliary rail 60. As a result, the fixing member 63 is rotatable about the boss 63*a* at the rear portion of the auxiliary rail 60. The fixing member 63 is, in a free state, rotationally moved in a direction in which one end thereof is downwardly moved into a fixed hole 65 provided to the apparatus main assembly 100A by its own weight or an urging member (not shown). In the case where the lifting member 61 is located at the descending end point, an end portion of the rear-side link 62 in an inclined rotational movement attitude (retracted position) urges the fixing member 63. As a result, the fixing member 63 is rotationally moved in an opposite direction to the direction in which it is downwardly moved about the boss 63*a* into the fixed hole 65 against its own weight or an urging force of the urging member, thus being held in a rotational movement attitude retracted from the fixed hole 65 (FIGS. 9 to 12).

Then, as described above, after the movement of the auxiliary rail 60 in the pull-out direction is stopped by the stopper portion 60*b* and the receiving portion 34*a*, the tray 35 is completely pulled out, so that the link 62 is rotationally moved in the standing direction to raise the lifting member 61. Thus, the urged state of the rear-side link 62 against the fixing member 63 is released, so that the fixing member 63 is placed in the free state. As a result, the one end of the fixing member 63 is rotationally moved in the direction in which it is moved downwardly into the fixing hole 65 provided to the apparatus main assembly 100A by its own weight or the urging force of the urging member, so that the fixing member end portion enters the fixing hole 65 to fix the direction in which the auxiliary rail 60 is returned into the apparatus main assembly 100A.

By employing such a constitution, when the cartridge P is set in the tray 35 and is intended to be returned into the apparatus main assembly, the auxiliary rail 60 is prevented from moving together with the tray 35. Therefore, it is possible to prevent such an operation that the cartridge P is caught during passing through the opening 30 before the cartridge P is moved downwardly and accommodated into the tray 35 by the movement of the tray 35 together with the auxiliary rail 60.

When the tray 35 is pulled out to the predetermined pull-out position and then the cartridge to be exchanged of the cartridges P raised from the mounting portions of the tray 35 by the upwardly moved lifting member 61 as shown in FIGS. 13 and 14 is exchanged, the tray 35 is moved and pushed into the apparatus main assembly 100A.

At an initial stage of the push-in movement, corresponding to the push-in movement of the tray 35, the boss 64 of the lifting member 61 engaging with the boss 62*a* of the link 62 is pushed rearward. As a result, the rotational movement moment acts on the link 62 in the direction in which the link 62 is rearward inclined about the boss 62*a*, so that the link 62 is rotationally moved in the direction in which the link 62 is rearward laid on its side. At this time, the boss 64 is downwardly moved in the groove 35*i*. Thus, by the rotational movement of the link in the rearward laid direction, the left and right lifting members 61 are downwardly moved. That is, the cartridges P (PY, PM, PC, PK) are lowered by the left and right lifting members 61 to be placed in a state in which they are accommodated in the mounting portions of the tray 35. Further, the lifting member 61 is moved to the descending end point, so that the end portion of the rear-side link 62 placed in the inclined rotational movement attitude (retracted position) urges the fixing member 63. As a result, the fixing member 63 is rotationally moved in the opposite direction to the direction in which it is moved downwardly about boss 63*a* into the fixing hole 65 against its own weight or the urging force of the urging member, thus being held in the retracted rotational movement attitude. That is, the fixation of the auxiliary rail 60 in the direction in which the auxiliary rail 60 is moved back into the apparatus main assembly 100A is released.

The tray 35 is continuously moved and pushed in, so that the tray 35 is returned to the state (the push-in position), before the pulling out, as shown in FIGS. 5 and 6. Then, the opened door 31 is closed as shown in FIGS. 1 and 2. In interrelation with the closing rotational movement of the door 31, the rail member 34 is moved rearward and downwardly by a predetermined distance. As a result, each cartridge P is located at the mounting position. In interrelation with the movement of the rail member 34, each cartridge P is surged by an urging member (not shown) to be fixed and hold at a predetermined position portion, so that the lower surface of the drum 1 of each cartridge P contacts the drum 13 in a predetermined manner. Further, to the driving force input portions 53 and 54 of the cartridge P, the driving force output portions of the apparatus main assembly are connected. Further, to the electrical contacts 55*a* and 55*b*, the electric power supplying system of the apparatus main assembly is electrically connected. Further, the positioning fixation of the tray 35 by the positioning fixation means is made.

As described above, with respect to the image forming apparatus in this embodiment, by the moving operation of the tray 35, the cartridge P is projected from the accommodation position in the tray 35 to facilitate the exchange of the cartridge. That is, when the tray 35 is pulled out, the mounted cartridges pop up automatically from the tray 35. As a result, the number of operable portions such as a side surface of each cartridge is increased, so that it is possible to facilitate the mounting and demounting operation of the cartridge.

Embodiment 2

In this embodiment, a schematic constitution of an image forming apparatus is similar to that of the image forming apparatus in Embodiment 1, thus being omitted from redundant description.

Figure 15:
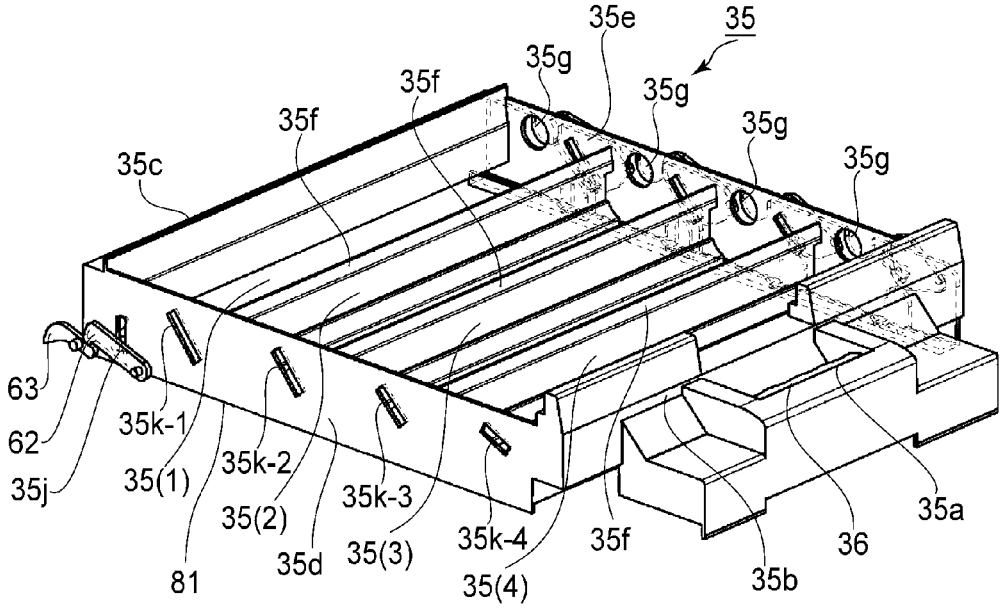
FIG. 15 is a perspective view of a tray in Embodiment 2.
Figure 16:
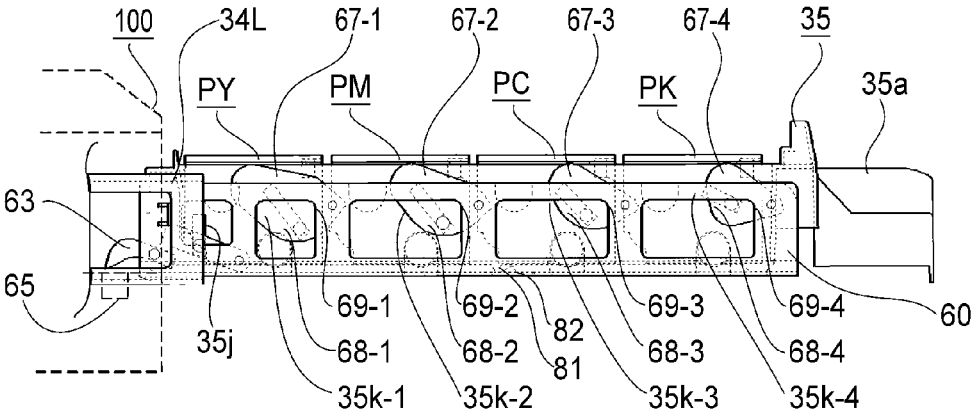
FIG. 16 is a left side view of the tray immediately before completely pulled out.
Figure 17:
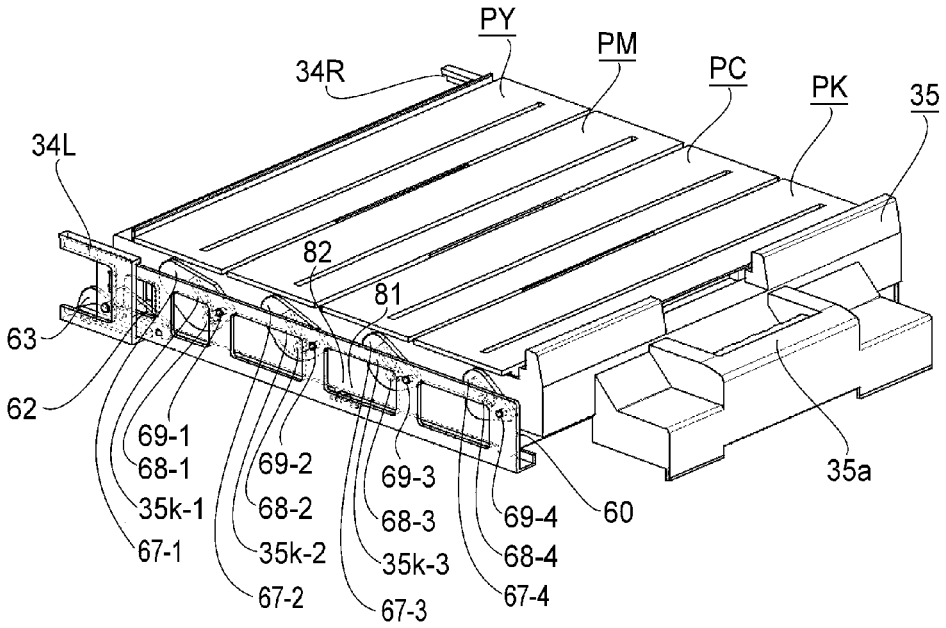
FIG. 17 is a perspective view of the tray immediately before completely pulled out.

FIG. 15 shows a constitution of the tray 35 in this embodiment. A basic constitution of the tray 35 is similar to that of the tray 35 in Embodiment 1. The left and right frame plates of the tray 35 are provided with left and right guide grooves 35*k*-1 to 35*k*-4 in a bilaterally-symmetric manner. Into the guide grooves 35*k*-1 to 35*k*-4, as shown in FIGS. 16 and 17, corresponding bosses 68-1 to 68-4 of cam members 67-1 to 67-4 are inserted. Further, the cam members 67-1 to 67-4 are rotatably mounted to the auxiliary rails 60 by inserting bosses 70 into holes 69-1 to 69-4 provided in the auxiliary rails 60.

Figure 18:
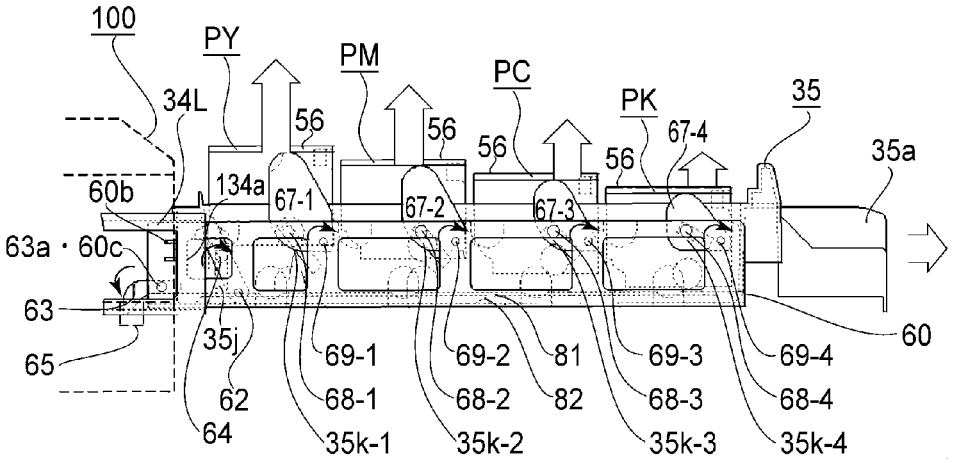
FIG. 18 is a left side view of the tray in a state in which the tray is completely pulled out.
Figure 19:
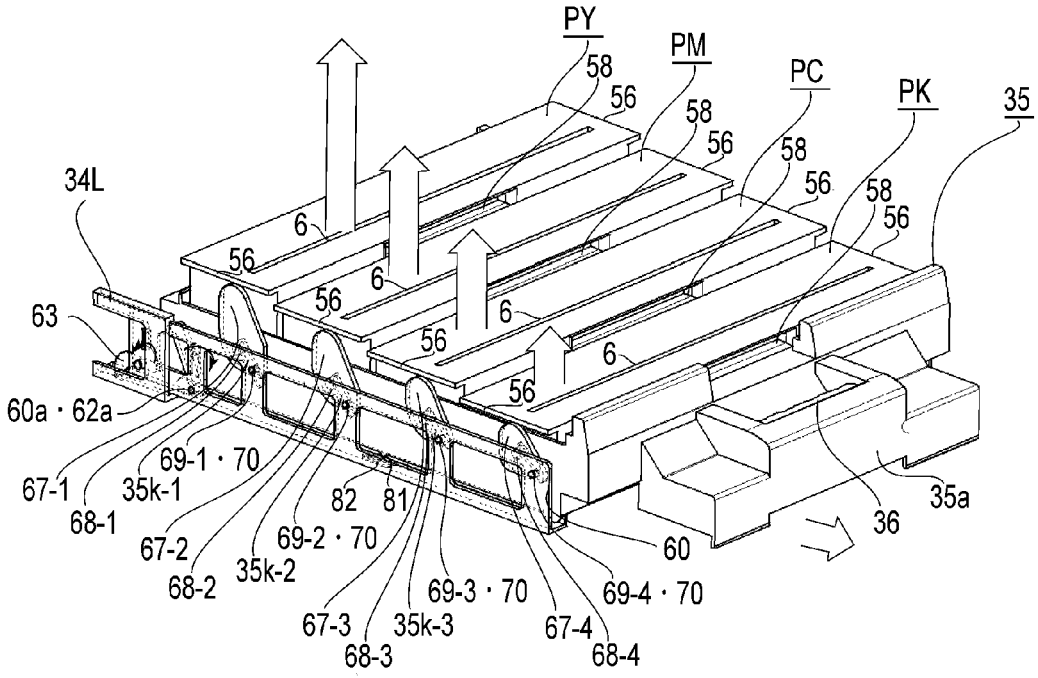
FIG. 19 is a perspective view of the tray in a state in which the tray is completely pulled out.

Similarly as in Embodiment 1, the auxiliary rails 60 are pulled out together with the tray 35 and are stopped (FIGS. 16 and 17). Thereafter, the tray 35 is further pulled out. As a result, as shown in FIGS. 18 and 19, the cam members 67-1 to 67-4 are guided by the guide grooves 35*k*-1 to 35*k*-4 and the bosses 68-1 to 68-4 and are rotated about the bosses 70 in the standing direction to push up eaves 56 of the cartridges P. That is, the cartridges P (PY, PM, PC, PK) are pushed up by the left and right cam members 67-1 to 67-4 to pop up from the mounting portions of the tray 35. The left and right cam members (lifting members) 67-1 to 67-4 hold the cartridges P accommodated in the tray in a raised state changed from the accommodated state when the tray 35 is pulled out to the pull-out position in which each cartridge position is mountable and demountable.

In this embodiment, the left and right cam members are used as a cartridge displacing member for displacing the cartridge P supported by the tray 35 pulled out to the pull-out position in the mounting and demounting direction in the tray (movable member) 35.

In this embodiment, the guide grooves 35*k*-1 to 35*k*-4 and the cam members 67-1 to 67-4 are different for the respective cartridges P (PY, PM, PC, PK), so that a pop-up amount of each cartridge P is also different. In this embodiment, from the front-side cartridge toward the rear-side cartridge, i.e., the pop-up amount is increased in the order of the fourth cartridge PK, the third cartridge PC, the second cartridge PM, and the first cartridge PY. For this reason, as shown in FIG. 19, it is also possible to provide a holding portion 58, as an operating portion, at a longitudinal central portion of each cartridge P. That is, in this embodiment, the cam members 67-1 to 67-4 change and displacement, every cartridge, for displacing the cartridges PY, PM, PC and PK in the mounting and demounting direction in the tray (movable member).

The respective cartridges (PY, PM, PC, PK) basically have the same shape. As a color of the cartridge frame (outer casing) 5 which defines the outer shape of the cartridge, black is selected in many cases from the viewpoints of a light-blocking property, cost reduction, etc. For that reason, in an image forming apparatus intended to be downsized, an interval between adjacent cartridges is reduced as small as possible, so that a cartridge to be exchanged is not easily discriminable at first view. Therefore, it is necessary to make contrivance such that a label for identifying each cartridge is frequently used. In the image forming apparatus in this embodiment, however, as shown in FIGS. 18 and 19, the respective cartridges pop up stepwisely to be discriminated at first view, so that the identifying indication such as the label or the like can be minimized.

As described above, in the image forming apparatus in this embodiment, the pop-up amount is different cartridge by cartridge when the plurality of cartridges PY, PM, PC and PK pops up. That is, a difference in pop-up amount of individual cartridges is provided and the operating portion is provided at the longitudinal central portion or the like of the cartridge at which fingers cannot enter a gap between adjacent cartridges when the cartridges are placed in the accommodated (retracted) state in which the cartridges are leveled with each other. Further, the cartridges pop up stepwisely by providing the difference in pop-up amount, so that it is possible to easily discriminate a boundary between a cartridge to be operated and a cartridge not to be operated.

In the above-described embodiments, the cartridge P is the process cartridge prepared by integrally supporting the image bearing member 1 and the process means, acting on the image bearing member 1, consisting of the charging means 2, the developing means 3 and the cleaning means 4 into a cartridge but is not limited thereto. That is, the cartridge P may only be required to include at least the image bearing member on which the latent image is to be formed and the developing means for developing the latent image, formed on the image bearing member, with the developer. The process means is, e.g., at leas one of the charging means, the developing means, and the cleaning means. The image bearing member is the member on which the latent image to be developed with the developer is to be formed. The image bearing member may also be the electrostatic recording dielectric member in the electrostatic recording process, the magnetic recording magnetic member in the magnetic recording process, and the like, in addition to the electrophotographic photosensitive member in the electrophotographic process as in the embodiments.

In the above-described embodiments, the tray 35 as the movable member is configured to support the four cartridges PY, PM, PC and PK disposed in parallel to each other with respect to the movement direction of the tray 35. However, the cartridges to be supported by the tray 35 may also be a single cartridge. Further, it is also possible to constitute the image forming apparatus in which two, three or five or more cartridge are supportable by the tray 35 in parallel to each other.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 243920/2008 filed Sep. 24, 2008, which is hereby incorporated by reference.

What is claimed is:

1. An image forming apparatus for forming an image on a recording material, comprising:

a main assembly;

a cartridge supporting member for supporting a cartridge, wherein said cartridge supporting member is movable between an outside position, in which the cartridge is located outside said main assembly, and an inside position, in which the cartridge is located inside said main assembly, and wherein said cartridge supporting member includes a mounting portion on which the cartridge is detachably mountable at the outside position;

an opening, provided in said main assembly, through which said cartridge supporting member passes when said cartridge supporting member moves between the inside position and the outside position;

a first displaceable member provided movably on said cartridge supporting member, wherein said first displaceable member is contactable with the cartridge and is movable between (i) a first position which permits the cartridge to be mounted on and demounted from the mounting portion when said cartridge supporting member is at the outside position, and (ii) a second position which is different from the first position and in which the cartridge, mounted on the mounting portion, is capable of passing through said opening, when said cartridge supporting member is moved from the outside position to the inside position; and a second displaceable member provided movably on said cartridge supporting member, wherein said second displaceable member is contactable with the cartridge and is movable between (i) a third position which permits the cartridge to be mounted on and demounted from the mounting portion when said cartridge supporting member is at the outside position, and (ii) a fourth position which is different from the third position and in which the cartridge, mounted on the mounting portion, is capable of passing through said opening, when said cartridge supporting member is moved from the outside position to the inside position, wherein said first displaceable member and said second displaceable member are provided on opposite sides of said cartridge supporting member, with respect to a longitudinal direction of the cartridge, wherein said first displaceable member is movable from the first position to the second position based on a force received from the main assembly by the movement from the outside position to the inside position of said cartridge supporting member, and wherein said second displaceable member is movable from the third position to the fourth position based on the force received from the main assembly by the movement from the outside position to the inside position of said cartridge supporting member.

2. An apparatus according to claim 1, wherein said cartridge supporting member is configured to support a plurality of cartridges, and wherein said first displaceable member and said second displaceable member each include a plurality of displaceable portions each of which corresponds to one of the plurality of cartridges.

3. An apparatus according to claim 1, wherein said cartridge supporting member is configured to receive the cartridge from a predetermined direction crossing (i) a movement direction of said cartridge supporting member and (ii) a longitudinal direction of the cartridge, when said cartridge supporting member is located at the outside position, and wherein said first displaceable member and said second displaceable member are further configured to allow the cartridge, mounted on the mounting portion, to move in the predetermined direction when said cartridge supporting member is moved from the outside position to the inside position.

4. An apparatus according to claim 1, wherein with respect to a direction in which the cartridge is mounted on said cartridge supporting member, said first displaceable member at the first position is located upstream of said first displaceable member at the second position.

5. An image forming apparatus for forming an image on a recording material, comprising:

a main assembly;

a cartridge supporting member for supporting a plurality of cartridges, wherein said cartridge supporting member is movable between an outside position, in which the cartridges are located outside said main assembly, and an inside position, in which the cartridges are located inside said main assembly, and wherein said cartridge supporting member includes a mounting portion on which the cartridges are detachably mountable at the outside position;

an opening, provided in said main assembly, through which said cartridge supporting member passes when said cartridge supporting member moves between the inside position and the outside position;

a plurality of first displaceable members provided movably on said cartridge supporting member, wherein said first displaceable members are contactable with the plurality of cartridges, respectively, and are movable between (i) first positions which permit the cartridges to be mounted on and demounted from the mounting portion when said cartridge supporting member is at the outside position, and (ii) second positions which are different from the first positions and in which the cartridges, mounted on the mounting portion, are capable of passing through said opening, when said cartridge supporting member is moved from the outside position to the inside position; and a plurality of second displaceable members provided movably on said cartridge supporting member, wherein said second displaceable members are contactable with the plurality of cartridges, respectively, and are movable between (i) third positions which permit the cartridges to be mounted on and demounted from the mounting portion when said cartridge supporting member is at the outside position, and (ii) fourth positions which are different from the third positions and in which the cartridges, mounted on the mounting portion, are capable of passing through said opening, when said cartridge supporting member is moved from the outside position to the inside position, wherein said first displaceable members and said second displaceable members are provided on opposite sides of said cartridge supporting member, with respect to a longitudinal direction of the cartridges, wherein said first displaceable members are movable from the first positions to the second positions based on a force received from the main assembly by the movement from the outside position to the inside position of said cartridge supporting member, and wherein said second displaceable members are movable from the third positions to the fourth positions based on the force received from the main assembly by the movement from the outside position to the inside position of said cartridge supporting member.

6. An apparatus according to claim 5, wherein said cartridge supporting member is configured to receive cartridges from a predetermined direction crossing (i) a movement direction of said cartridge supporting member and (ii) a longitudinal direction of the cartridges, when said cartridge supporting member is located at the outside position, and wherein said first displaceable members and said second displaceable members are further configured to allow the cartridges, mounted on the mounting portion, to move in the predetermined direction when said cartridge supporting member is moved from the outside position to the inside position.

7. An apparatus according to claim 5, wherein said cartridge supporting member is further configured to receive cartridges which contain a yellow developer, a magenta developer, a cyan developer and a black developer, respectively.

8. An apparatus according to claim 5, wherein with respect to a direction in which the cartridges are mounted on said cartridge supporting member, said first displaceable members at the first positions are located upstream of said first displaceable members at the second positions, and said second displaceable members at the third positions are located upstream of said second displaceable members at the fourth positions.

9. An image forming apparatus for forming an image on a recording material, comprising:

a main assembly;

a cartridge supporting member for supporting a plurality of cartridges, wherein said cartridge supporting member is movable between an outside position, in which the cartridges are located outside said main assembly, and an inside position, in which the cartridges are located inside said main assembly, and wherein said cartridge supporting member includes a mounting portion on which the cartridges are detachably mountable at the outside position;

an opening, provided in said main assembly, through which said cartridge supporting member passes when said cartridge supporting member moves between the inside position and the outside position;

a plurality of displaceable members provided movably on said cartridge supporting member, wherein said displaceable members are contactable with a plurality of cartridges, respectively, and are movable between (i) first positions which permit the cartridges to be mounted on and demounted from the mounting portion when said cartridge supporting member is at the outside position, and (ii) second positions which are different from the first positions and in which the cartridges, mounted on the mounting portion, are capable of passing through said opening, when said cartridge supporting member is moved from the outside position to the inside position, wherein said displaceable members are movable from the first positions to the second positions based on a force received from the main assembly by the movement from the outside position to the inside position of said cartridge supporting member.

10. An apparatus according to claim 9, wherein said cartridge supporting member is configured to receive cartridges from a predetermined direction crossing (i) a movement direction of said cartridge supporting member and (ii) a longitudinal direction of the cartridges, when said cartridge supporting member is located at the outside position, and wherein said displaceable members are further configured to allow the cartridges, mounted on the mounting portion, to move in the predetermined direction when said cartridge supporting member is moved from the outside position to the inside position.

11. An apparatus according to claim 9, wherein with respect to a direction in which the cartridges are mounted on said cartridge supporting member, said displaceable members at the first positions are located upstream of said displaceable members at the second positions.

12. A cartridge supporting member for supporting a plurality of cartridges and for use with an image forming apparatus including a main assembly and an opening provided in the main assembly, wherein the cartridge supporting member is movable between an outside position, in which the cartridges are located outside the main assembly, and an inside position, in which the cartridges are located inside the main assembly, the cartridge supporting member comprising:

a mounting portion on which the cartridges are detachably mountable at the outside position, wherein the cartridge supporting member passes through the opening when the cartridge supporting member moves between the inside position and the outside position;

a plurality of displaceable members provided movably on the cartridge supporting member, wherein said displaceable members are contactable with a plurality of cartridges, respectively, and are movable between (i) first positions which permit the cartridges to be mounted on and demounted from said mounting portion when the cartridge supporting member is at the outside position, and (ii) second positions which are different from the first positions and in which the cartridges, mounted on said mounting portion, are capable of passing through said opening, when the cartridge supporting member is moved from the outside position to the inside position, wherein said displaceable members are movable from the first positions to the second positions based on a force received from the main assembly by the movement from the outside position to the inside position of the cartridge supporting member.

13. A cartridge supporting member according to claim 12, wherein the cartridge supporting member is configured to receive the cartridges from a predetermined direction crossing (i) a movement direction of said cartridge supporting member and (ii) a longitudinal direction of the cartridges, when the cartridge supporting member is located at the outside position, and wherein said displaceable members are further configured to allow the cartridges, mounted on said mounting portion, to move in the predetermined direction when the cartridge supporting member is moved from the outside position to the inside position.

14. A cartridge supporting member according to claim 12, wherein with respect to a direction in which the cartridges are mounted on the cartridge supporting member, said displaceable members at the first positions are located upstream of said displaceable members at the second positions.

15. A cartridge supporting member according to claim 12, further comprising second displaceable members, wherein said second displaceable members are contactable with a plurality of cartridges, respectively, and are movable between (i) third positions which permit the cartridges to be mounted on and demounted from said mounting portion when said cartridge supporting member is at the outside position, and (ii) fourth positions which are different from the third positions and in which the cartridges, mounted on said mounting portion, are capable of passing through said opening, when the cartridge supporting member is moved from the outside position to the inside position, wherein said displaceable members and said second displaceable members are provided on opposite sides of the cartridge supporting member, with respect to a longitudinal direction of the cartridges.

16. A cartridge detachably mountable to a cartridge supporting member in an image forming apparatus which includes:

a main assembly;

a cartridge supporting member for supporting a plurality of cartridges, wherein the cartridge supporting member is movable between an outside position, in which the cartridges are located outside the main assembly, and an inside position, in which the cartridges are located inside the main assembly, and wherein the cartridge supporting member includes a mounting portion on which the cartridges are detachably mountable at the outside position;

an opening, provided in the main assembly, through which the cartridge supporting member passes when the cartridge supporting member moves between the inside position and the outside position; and a plurality of displaceable members provided movably on the cartridge supporting member, wherein the displaceable members are contactable with the plurality of cartridges, respectively, and are movable between (i) first positions which permit the cartridges to be mounted on and demounted from the mounting portion when the cartridge supporting member is at the outside position, and (ii) second positions which are different from the first positions and in which the cartridges, mounted on the mounting portion, are capable of passing through the opening, when the cartridge supporting member is moved from the outside position to the inside position, and wherein the displaceable members are movable from the first positions to the second positions based on a force received from the main assembly by the movement from the outside position to the inside position of the cartridge supporting member, said cartridge comprising:

a portion-to-be-contacted contactable with one of the plurality of displaceable members, wherein the cartridge is configured such that when mounted on the cartridge supporting member the cartridge is movable between (i) a third position where the cartridge is mountable and demountable, and (ii) a fourth position, different from the third position, which permits the cartridge, mounted on the mounting portion, to pass through the opening, when the cartridge supporting member is moved from the outside position to the inside position.

* * * * *